US009802287B2

(12) United States Patent
Brechemier

(10) Patent No.: US 9,802,287 B2
(45) Date of Patent: Oct. 31, 2017

(54) SYSTEM COMPRISING A POSITIONING AND CENTERING PIN FOR AN OPHTHALMIC LENS, AN ATTACHMENT MEMBER AND A TOOL FOR POSITIONING SAID ATTACHMENT MEMBER ON SAID POSITIONING AND CENTERING PIN

(71) Applicant: ESSILOR INTERNATIONAL (COMPAGNIE GÉNÉRALE D'OPTIQUE), Charenton-le-pont (FR)

(72) Inventor: Bernard Brechemier, Charenton-le-Pont (FR)

(73) Assignee: ESSILOR INTERNATIONAL (COMPAGNIE GENERALE D'OPTIQUE), Charenton-le-Pont (FR)

( * ) Notice: Subject to any disclaimer, the term of this patent is extended or adjusted under 35 U.S.C. 154(b) by 524 days.

(21) Appl. No.: 14/382,362

(22) PCT Filed: Feb. 19, 2013

(86) PCT No.: PCT/FR2013/050334
§ 371 (c)(1),
(2) Date: Sep. 2, 2014

(87) PCT Pub. No.: WO2013/128096
PCT Pub. Date: Sep. 6, 2013

(65) Prior Publication Data

US 2015/0024664 A1 Jan. 22, 2015

(30) Foreign Application Priority Data

Mar. 2, 2012 (FR) ..... 12 51929

(51) Int. Cl.
*B24B 41/06* (2012.01)
*B24B 13/005* (2006.01)
(Continued)

(52) U.S. Cl.
CPC ..... *B24B 13/0055* (2013.01); *B24B 9/14* (2013.01); *B24B 9/146* (2013.01); *B24B 13/005* (2013.01);
(Continued)

(58) Field of Classification Search
USPC ..... 451/390; 269/21, 43, 289 R, 900; 29/281.1, 281.5, 270
See application file for complete search history.

(56) References Cited

U.S. PATENT DOCUMENTS 3,962,833 A * 6/1976 Johnson ..... B24B 13/005 428/40.6
6,888,626 B2 5/2005 Levecq et al.
(Continued)

FOREIGN PATENT DOCUMENTS

EP 1 393 036 3/2004
EP 1 919 663 11/2009
(Continued)

OTHER PUBLICATIONS

International Search Report dated May 24, 2013, corresponding to PCT/FR2013/050334.

*Primary Examiner* — Joseph J Hail
*Assistant Examiner* — Shantese McDonald
(74) *Attorney, Agent, or Firm* — Young & Thompson

(57) ABSTRACT

A system includes a positioning and centering pin (4) configured to be attached to an ophthalmic lens, an attachment member (5) configured to be positioned on and attached to the pin and to be attached to the lens, a tool (20) for positioning the attachment member on the pin, and which includes a body (42) provided with at least one receiving recess configured to at least partially receive at least one of the attachment members and the pin, at least one centering member (48, 56) and at least one guide member (48, 57),
(Continued)

which are configured such that, when the attachment member and the pin are mounted on the tool, the attachment member is centered relative to the body and the pin is guided relative to the body, whereby the attachment member is positioned in a predetermined position on the pin.

18 Claims, 6 Drawing Sheets

(51) Int. Cl.
*B24B 47/22* (2006.01)
*B24B 9/14* (2006.01)

(52) U.S. Cl.
CPC ..... *B24B 47/225* (2013.01); *Y10T 29/49998* (2015.01)

(56) References Cited

U.S. PATENT DOCUMENTS

| | | | | |
|---|---|---|---|---|
| 6,918,822 | B2 * | 7/2005 | Arai | B24B 9/146 451/390 |
| 7,467,472 | B2 | 12/2008 | Jacq | |
| 8,209,046 | B2 | 6/2012 | Brechemier et al. | |
| 2003/0015649 | A1 | 1/2003 | Levecq et al. | |
| 2008/0216330 | A1 | 9/2008 | Jacq | |
| 2010/0115752 | A1 | 5/2010 | Goerges | |
| 2010/0228375 | A1 * | 9/2010 | Brechemier | B24B 9/146 700/110 |

FOREIGN PATENT DOCUMENTS

| | | |
|---|---|---|
| EP | 2 139 642 | 1/2010 |
| EP | 2 204 259 | 7/2010 |
| WO | 02/099376 | 12/2002 |

* cited by examiner

Fig. 1
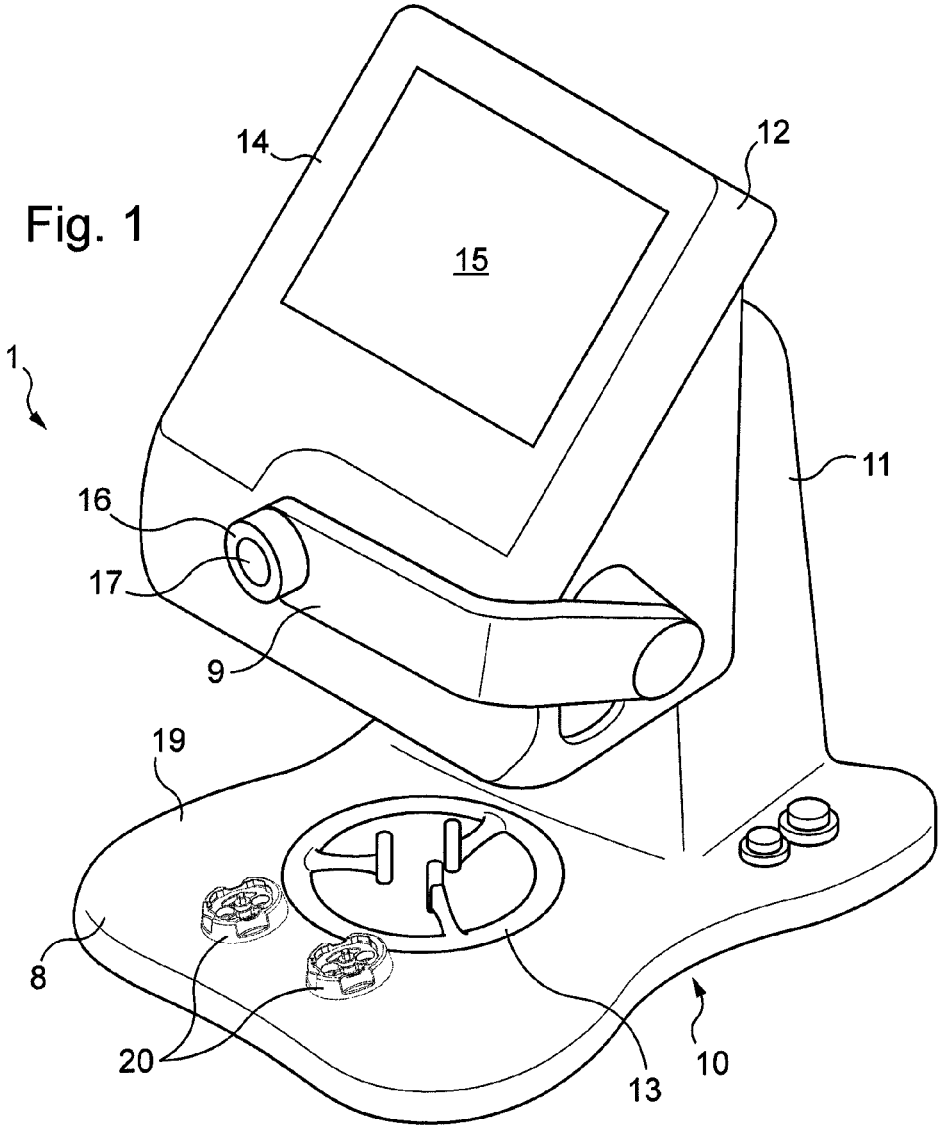
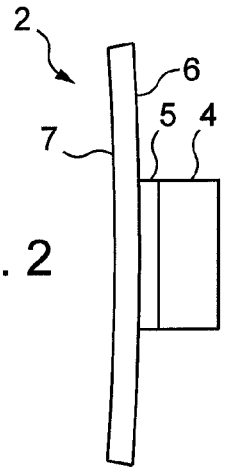
Fig. 2

SYSTEM COMPRISING A POSITIONING AND CENTERING PIN FOR AN OPHTHALMIC LENS, AN ATTACHMENT MEMBER AND A TOOL FOR POSITIONING SAID ATTACHMENT MEMBER ON SAID POSITIONING AND CENTERING PIN

BACKGROUND OF THE INVENTION

Field of the Invention

The invention relates to the general field of the positioning of attachment members on positioning and centering pins for ophthalmic lenses in order to subsequently attach these positioning and centering pins to these lenses, and the invention concerns in particular the systems comprising such a positioning and centering pin, such an attachment member and a tool for positioning the attachment member on the positioning and centering pin, and groups of such systems.

The invention also relates to methods for positioning such attachment members on such positioning and centering pins.

Description of the Related Art

The invention also concerns machines for positioning ophthalmic lenses on and attaching them to such positioning and centering pins.

It is known that ophthalmic lenses undergo various manufacturing steps. The manufacturing processes generally employed to obtain a finished lens trimmed to the shape of a particular frame typically comprise steps in which the surface of the ophthalmic lens is provided with marks.

Moreover, whether for marking steps or for manufacturing steps as such, for instance surfacing (for example machining) or finishing (for example trimming), the ophthalmic lenses must be held in a given position and be centered with respect to a given positioning reference.

For this purpose, it is common to use centering and positioning pins which are attached to the ophthalmic lenses by virtue of attachment members, the latter being formed for example by adhesive pads.

Prior to the attachment of the pin to the lens via the attachment member, the latter is itself attached to the pin and this attachment is generally carried out by manual positioning of this attachment member on the pin.

This manual positioning is by nature random, relative to a given correct position, and can cause problems during the following steps.

Specifically, incorrect positioning of the attachment member on the positioning and centering pin can result in incorrect positioning of the positioning and centering pin on the lens and thus cause the lens, for example during trimming, to move in rotation (alone or together with the attachment member) with respect to the positioning and centering pin, in other words bring about a misalignment for example on account of shearing of the attachment member during the trimming of the periphery of the lens.

Moreover, incorrect positioning of the positioning and centering pin on the lens on account of incorrect positioning of the attachment member on the positioning and centering pin can conceal the previously made marks, these being necessary for example for correctly positioning the lens on a trimming machine.

These marks may be formed by etchings that represent points or crosses and identify a particular point (for example the optical center of the ophthalmic lens or the prism reference point for a progressive lens), or axis lines (for example for indicating the horizontal axis along which astigmatism is corrected), or shapes delimiting a particular zone (for example a near vision zone or a far vision zone in the case of progressive ophthalmic lenses).

The positioning of the lens on the positioning and centering pin, and consequently the prior positioning of the attachment member on the positioning and centering pin, for the purpose of carrying out a trimming step, is rendered particularly complicated on account of the large number of spectacle frames having different shapes, necessitating multiple sizes of the positioning and centering pins and multiple sizes of the attachment members.

Correctly positioning an attachment member on a positioning and centering pin is thus complex.

BRIEF SUMMARY OF THE INVENTION

The invention aims to provide a system for positioning an attachment member on a positioning and centering pin for an ophthalmic lens, said system being simple, practical and economical both in terms of manufacturing and in terms of use.

Thus, a subject of the invention, according to a first aspect, is a system comprising a positioning and centering pin for an ophthalmic lens, said positioning and centering pin being configured to be attached to said ophthalmic lens, and an attachment member configured to be positioned on said positioning and centering pin and to be attached to the latter and also to be attached to said ophthalmic lens, characterized in that said system also has a tool for positioning said attachment member on said positioning and centering pin, said tool having a body provided with at least one receiving recess configured to at least partially receive at least one of said attachment member and said positioning and centering pin, at least one centering member for centering said attachment member, and at least one guiding member for guiding said positioning and centering pin; said recess, said at least one centering member and said at least one guiding member being configured such that, when said attachment member and said positioning and centering pin are mounted on said tool, said attachment member is centered with respect to said body and said positioning and centering pin is guided with respect to said body; by virtue of which said attachment member is positioned in a predetermined position on said positioning and centering pin.

The system according to the invention forms an aid for a user, for example an optician, in order to position the attachment member on the positioning and centering pin to which this member is attached, regardless of the size and shape of the pin and of the attachment member inasmuch as the tool is configured to take them.

The advantage of the tool of the system according to the invention is that the attachment member is positioned on the pin correctly and in a repeatable manner. The same attachment members will always be attached more or less at the same location on the same pins.

The tool of the system according to the invention may have a shape and/or dimensions that allow it to take a number of sizes of pins and attachment members, these being configured to then be attached to an ophthalmic lens before undergoing steps of a machining and/or finishing method, for example trimming in order to adapt this lens to a spectacle frame.

Such a trimming step, carried out by an optician, requires what are referred to as manual preparatory steps, such as positioning the attachment member on the positioning and centering pin, it being necessary for these preparatory steps to be particularly simple to implement while being particularly reliable. The tool of the system according to the invention advantageously affords this reliability and this simplicity of fitting the attachment member on the positioning and centering pin, in what is referred to as a correct given position.

The subsequent preparatory steps are implemented with the aid of machines having a robot arm on which the optician positions, in a single possible position, the pin with the member attached to this pin. Geometric features of the frame are sent to the machine, which reads, for example by way of a camera, the characteristics of the lens, these characteristics being defined by the shape of the lens and by the marks it bears. The robot arm then positions the positioning and centering pin and the member on the lens in order to attach this pin to this lens via the attachment member, positioning then being determined depending on various parameters such as the choice of centering with respect to the optical center of the lens or with respect to the center of the spectacle frame, the instructions for the trimming machine being different depending on the choice.

It is clear that if the positioning, carried out manually, of the attachment member on the positioning and centering pin is incorrect, it goes without saying that the final positioning of the positioning and centering pin on the lens will be incorrect, it being possible for the tool of the system according to the invention to avoid this.

The system according to the invention is also particularly practical, compact and economical, and when it is wrapped in an appropriate pack (which may be particularly simple), the unit formed by the system and the pack is easy to handle, transport and store.

According to preferred, simple, practical and economical features of the system according to the invention:

at least one of said positioning and centering pin and said attachment member has a cylindrical overall shape having a peripheral contour, and said body has a cavity having a cylindrical overall shape delimited by a bottom and a peripheral rim, said cavity having a peripheral contour at least partially similar to and at least as large as said peripheral contour of at least one of said positioning and centering pin and said attachment member, and said guiding member for guiding said positioning and centering pin is at least partially formed by said peripheral rim;

said at least one receiving recess is provided in at least one part of said bottom of said cavity in said body and in at least one first part of said peripheral rim of said body, said first part of said peripheral rim being located at the junction with said bottom;

said at least one receiving recess is provided in at least one second part of said peripheral rim of said body, said second part of said peripheral rim being located away from said bottom of said cavity in said body;

said at least one centering member for centering said attachment member is formed by a protrusion protruding from a bottom of a cavity in said body, and said attachment member has an orifice configured for said protrusion to pass through;

said at least one guiding member for guiding said positioning and centering pin is formed by a stem protruding from said protrusion, and said positioning and centering pin has a hole configured to receive said stem;

said positioning and centering pin has at least one error-proofing element and said body of said tool has at least one complementary error-proofing element configured to engage with said at least one error-proofing element of said positioning and centering pin;

said at least one error-proofing element of said positioning and centering pin is formed by a positioning tab and said at least one complementary error-proofing element of said body of said tool is formed by a notch provided in a peripheral rim of said body and configured to receive said positioning tab;

said attachment member has at least one first removal element, said positioning and centering pin has at least one second removal element and said body of said tool has at least one complementary removal element configured to engage with said at least one first removal element and with said at least one second removal element; and/or said at least one first removal element of said attachment member is formed by a gripping tongue, said at least one second removal element of said positioning and centering pin is formed by a protuberance and said at least one complementary removal element of said body of said tool is formed by an indentation provided in a peripheral rim of said body and configured to receive said tongue and said protuberance.

A further subject of the invention, according to a second aspect, is a group of systems having a first system as described above and a second system as described above, said first system having a first attachment member, a first positioning and centering pin and a first tool, each having a respective first predetermined size, and said second system having a second attachment member, a second positioning and centering pin and a second tool, each having a respective second predetermined size that is less than said first predetermined size.

Such a group can be produced in a particularly simple, practical and economical manner since the main features of the systems are identical.

Moreover, this group makes it possible to very simply adapt the tool to the attachment member and to the positioning and centering pin that are necessary for positioning an ophthalmic lens for example in a machine for trimming this lens.

According to preferred, simple, practical and economical features of the group according to the invention:

said first tool has a first body provided with a first interlocking face and said second tool has a second body provided with a complementary second interlocking face configured to be received in said first interlocking face; and/or the group also has a bar that is shared by the first and second systems and is configured to pass through said first and second bodies, said bar having a central portion that forms a protrusion for centering said first and second attachment members and two end portions that are disposed on either side of said central portion, said end portions forming guiding stems for guiding the first and second positioning and centering pins, respectively.

A further subject of the invention, according to a third aspect, is a method for positioning an attachment member on a positioning and centering pin for an ophthalmic lens with the aid of a system, having the following steps of:

providing a positioning and centering pin for an ophthalmic lens, said positioning and centering pin being configured to be attached to said ophthalmic lens;

providing an attachment member configured to be positioned on said positioning and centering pin and to be attached to the latter and also to be attached to said ophthalmic lens;

the method being characterized in that it also comprises the following steps of:

providing a tool having a body provided with at least one receiving recess configured to at least partially receive at least one of said attachment member and said positioning and centering pin, with at least one centering member for centering said attachment member, and with at least one guiding member for guiding said positioning and centering pin;

at least partially disposing at least one of said attachment member and said positioning and centering pin in said at least one receiving recess;

guiding said positioning and centering pin with respect to said body by way of said at least one guiding member for guiding said tool;

centering said attachment member with respect to said body by way of said at least one centering member for centering said tool; by virtue of which said attachment member is positioned in a predetermined position on said positioning and centering pin.

The positioning method according to the invention is particularly effective, simple, practical and economical to implement.

By virtue of the invention, it is particularly simple for a user, for example an optician, to position the attachment member and the positioning and centering pin on the tool so as to correctly position the attachment member on this positioning and centering pin, in order that the ophthalmic lens is then positioned correctly (most often by virtue of a machine) on and with respect to this pin, and in particular on this attachment member, which is then interposed between the lens and the pin to which it is configured to be attached.

A further subject of the invention, according to a fourth aspect, is a machine for positioning an ophthalmic lens on and attaching it to a positioning and centering pin by way of an attachment member previously positioned on and attached to said positioning and centering pin, having at least one system as described above.

BRIEF DESCRIPTION OF THE DRAWINGS

The exposition of the invention will now continue with a description of an exemplary embodiment, given below by way of illustration and nonlimiting example, and with reference to the appended drawings in which:

FIG. 1 schematically and partially shows a perspective view of a machine for positioning an ophthalmic lens on a positioning and centering pin for the purpose of a lens trimming step;

FIG. 2 schematically shows a sectional view of an ophthalmic lens attached to a positioning and centering pin, an attachment member being interposed between the lens and the pin;

DETAILED DESCRIPTION OF THE PREFERRED EMBODIMENTS

Figure 3:
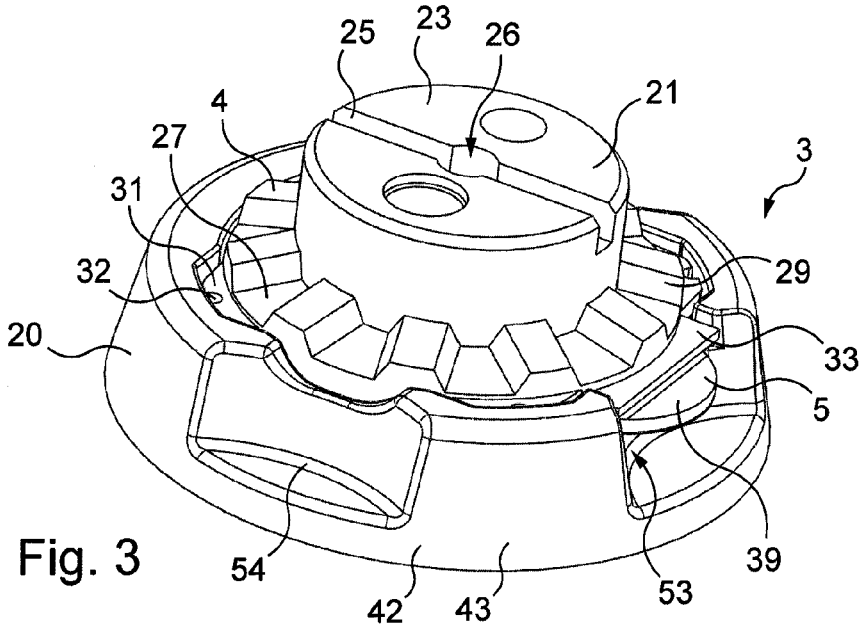
FIG. 3 schematically and partially shows a perspective view of a system in accordance with a first embodiment, comprising a tool, a positioning and centering pin and an attachment member in an assembled state.

FIG. 1 illustrates a machine 1 for positioning an ophthalmic lens 2 on and attaching it to a positioning and centering pin 4 by way of an attachment member 5 (visible in FIG. 2) previously positioned on and attached to the positioning and centering pin 4.

FIG. 2 illustrates the ophthalmic lens 2 attached to the positioning and centering pin 4 by virtue of the attachment member 5.

The ophthalmic lens 2 has a front face 6 and a rear face 7.

The attachment member 5 is a substantially elastic adhesive pad which is fixed to the front face 6 of the lens 2.

The positioning and centering pin 4 is made of plastics material molded in one piece.

The machine 1 is a machine substantially similar to the machines of which the configuration and operation are described in the European patent applications EP 1 393 036, EP 2 139 642 and EP 1 919 663.

The machine 1 has a base 10, a stand 11 rising from the base 10 and a monitor 12 overhanging the base 10.

The base 11 is provided with a mount 13 in the form of a tripod configured to hold the lens 2.

The monitor 12 is provided with a human-machine interface 14 formed here in particular by a touch screen 15 on which a user of this machine 1, for example an optician, can work.

The machine 1 is also provided with a robot arm 9 fixed to and articulated on the monitor 12.

This robot arm 9 carries, at an end opposite to its junction with the monitor 12, a circular holding end piece 16 that has a cylindrical cavity 17 for receiving what is referred to as a base part of the positioning and centering pin 4, the adhesive pad 5 having previously been positioned on and attached to said positioning and centering pin 4.

The optician thus positions the pin 4 in a single possible position, with the pad 5 attached to this pin 5.

Geometric features of the frame are sent to the machine 1 and the latter reads, for example by way of a camera (not shown), the characteristics of the lens 2, these characteristics being defined by the shape of the lens and by the marks it bears.

The robot arm 9 then positions the positioning and centering pin 4 and the pad 5 on the lens 2 placed on the mount 13 in order to attach this pin 4 to this lens 2 via the pad 5.

The position of the pin 4 on the lens 2 is determined depending on various parameters such as the choice of centering with respect to the optical center of the lens or with respect to the center of a spectacle frame.

The machine 1 is also provided with a casing 8 that covers almost all of the base 10 and the stand 11.

Unlike the prior art machines cited above, the base 10 has two tools 20 that are directly integrated into the casing 8, said tools 20 serving to position the adhesive pad 5 on the positioning and centering pin 4.

This casing 8 is made of plastics material molded in one piece.

These tools 20 protrude slightly from a flat face 19 of this casing 8.

A tool 20 and more generally a system 3 provided with such a tool 20 will now be described in more detail, with reference to FIGS. 3 to 5.

This system 3 comprises the positioning and centering pin 4 for the ophthalmic lens 2, the adhesive pad 5 and the tool 20.

The positioning and centering pin 4 is configured to be attached to the ophthalmic lens 2.

The adhesive pad 5 is configured to be positioned on the positioning and centering pin 4 and to be attached to the latter and also to be attached to the ophthalmic lens 2.

The tool 20 is for its part configured to allow correct positioning in a given position of the adhesive pad 5 on the positioning and centering pin 4.

The positioning and centering pin 4 has a base 21 having a cylindrical overall shape and an annular wall 22 forming a flange fastened to one end and to the periphery of the base 21.

The base 21 has an upper face 23 and a lower face 24 opposite the upper face 23, with the annular wall 22 which extends from this lower face 24.

The base 21 also has a slot that passes radially through it and opens onto the upper face 23 and onto the periphery of this base 21.

The base 21 also has a central through-hole 26, that is to say a hole which leads into the slot 25, into the upper face 23 and also into the lower face 24.

The base 21 also has a U-shaped cutout 58 provided in its lower face 24.

The annular wall 22 that forms a flange is for its part somewhat frustoconical so as to be able to substantially mate with the front face 6 of the ophthalmic lens 2. This annular wall 22 has an upper face 27 and a lower face 28.

Provided on the upper face 27 are a plurality of teeth 29 which are distributed regularly over this upper face 27.

These teeth 29 make it possible to position the unit formed by the positioning and centering pin 4 and the adhesive pad 5 in the receiving cavity 17 in the holding protrusion 16 on the robot arm 9 of the machine 1.

The annular wall 22 also has a plurality of ribs 30 provided on its lower face 28, said ribs 30 being distributed regularly over this lower face 28.

These ribs 30 ensure that the adhesive pad 5 is attached properly to the positioning and centering pin 4, in particular to the lower face 28 of the annular wall 22.

The annular wall 22 also has four positioning tabs 31 that each have substantially the shape of a rectangular trapezoid and each extend from a peripheral edge of the annular wall 22.

Each positioning tab 31 has an apex in which a slight depression 32 is provided.

These positioning tabs 31 form error-proofing elements for correctly positioning the positioning and centering pin 4 in a predetermined position on the tool 20, as will be described below.

The annular wall 22 of the positioning and centering pin 4 also has a protuberance 33 which protrudes from the peripheral edge of this annular wall 22 and is disposed between two positioning tabs 31.

This protuberance 33 has a partially rectangular contour and is provided to make it easier to remove the positioning and centering pin 4 from the tool 20.

The configuration of the annular wall 22 with respect to the base 21 allows access to the hole 26 in this base 21 from the lower face 24 thereof, through the annular wall 22.

The base 21 and the annular wall 22 are in fact circular, with the base 21 having a first diameter and the annular wall 22 having a second outside diameter larger than the first diameter.

The adhesive pad 5, also referred to as the attachment member, has a substantially elastic body 34 with a cylindrical shape, a circular orifice 35 being provided in said body.

This adhesive pad 5 is provided with an upper face 36, a lower face 37 opposite the upper face 36, and a circular external peripheral rim 38.

This adhesive pad 5 is thus circular and also has a gripping tongue 39 protruding from the external peripheral rim 38.

This gripping tongue 39 makes it easier to remove the adhesive pad 5 from the tool 20.

The upper face 36 and lower face 37 are covered with an adhesive product and, in the initial state, this upper face 36 and lower face 37 are each covered with a protective film (not shown) in order to make it easier to handle the adhesive pad 5.

Of course, the protective film covering the upper face 36 is removed when the adhesive pad 5 is positioned on the positioning and centering pin 4 by way of the tool 20, and the protective film covering the lower face 37 is removed when the lens 2 is positioned on the unit formed by the positioning and centering pin 4 and the adhesive pad 5 by way of the machine 1 and in particular the robot arm 9.

This adhesive pad 5 has a third outside diameter similar to the second outside diameter of the annular wall 22 of the positioning and centering pin 4.

Here, the second outside diameter of the annular wall 22 of the positioning and centering pin 4 and the third outside diameter of the adhesive pad 5 are equal to around 20 mm.

The tool 1 has a body 42 provided with a somewhat frustoconical external side wall 43, an upper face 44 and a lower face 45 opposite the upper face 44.

The body 42 has a main cavity 46 having a cylindrical overall shape delimited by a bottom 47 and by a peripheral rim 48.

The peripheral rim 48 has a predetermined height.

The body 42 also has voids 49 provided in the lower face 45 and also voids 50 provided in the bottom 47.

These voids 49 and 50 result from the production of the body 42 of the tool 20 from plastics material in one piece.

The main cavity 46 has a peripheral contour 51 partially similar to and at least as large as the peripheral contour of the positioning and centering pin 4 and of the adhesive pad 5, such that, as will be seen in more detail below, the peripheral rim 48 of the body 43 partially forms a guiding member both for the positioning and centering pin 4 and for the adhesive pad 5.

This peripheral rim has, in the main cavity 46, four notches 52 that are configured to receive the positioning tabs 31 of the positioning and centering pin 4.

These notches 52 form complementary error-proofing elements for positioning the positioning and centering pin 4 on the tool 20.

The body 42 also has an indentation 53 likewise provided in the peripheral rim 48, between two notches 52.

This indentation 43 forms a complementary removal element and is configured to receive the gripping tongue 39 of the adhesive pad 5 and the protuberance 33 on the annular wall 22 of the positioning and centering pin 4.

The body 42 of the tool 20 also has three other voids 54 provided in the external side wall 43.

These voids are also formed during the molding of the tool 20 and make it possible to lighten this tool 20 and thus to use less plastics material; they also make it possible for a user, for example the optician, to hold the tool 20 both when the adhesive pad 5 and the positioning and centering pin 4 are mounted on this tool 20 and when they are removed therefrom.

The main cavity 46, together with the peripheral rim 48, the notches 52 and the notches 53, form a receiving recess provided in a part of the bottom 47 of the main cavity 46 and in a first part of the height of the peripheral rim 48, said first part of the peripheral rim 48 being located at the junction with the bottom 47, wherein this receiving recess is configured to receive the adhesive pad 5, and this receiving recess is also provided in a second part of the height of the peripheral rim 48, said second part being located away from the first part and thus from the bottom 47 of the main cavity 46, wherein the receiving recess is then configured to at least partially receive the positioning and centering pin 4, in particular its annular wall 22 that forms a flange.

The body 42 of the tool 20 also has a protrusion 56 protruding from the bottom 47 of the main cavity 46.

This protrusion 56 has a cylindrical, and even circular, overall shape and has a diameter similar to the diameter of the orifice 35 in the adhesive pad 5.

This protrusion 56 has a sufficient height to both guide and center the adhesive pad 5 when the latter is mounted on the body 42 of the tool 20.

This protrusion 56 thus forms a centering member for centering the adhesive pad 5, and even a guiding member for guiding this pad, on account of the fact that the orifice 35 in the adhesive pad 5 is configured for this protrusion 56 to pass through.

The body 42 of the tool 20 also has a stem 57 protruding from the protrusion 56.

This stem 57 has, in section, a keyhole shape, that is to say it has two regions that each have a different diameter.

The larger-diameter region of the stem 57 has a diameter similar to the diameter of the hole 26 while the smaller-diameter region of the stem 57 has a diameter similar to the width of the U-shaped cutout 58.

This stem 57 has a height which makes it possible in particular to guide the positioning and centering pin 4 when the latter is mounted on the body 42 of the tool 20.

This stem 57 thus forms a guiding member for guiding the positioning and centering pin 4 and also forms, on account of its keyhole shape, a complementary error-proofing element.

The method for positioning the adhesive pad 5 on the positioning and centering pin 4 for the ophthalmic lens 2 with the aid of the system 3 illustrated in FIGS. 3 to 5 will now be described.

As indicated previously, the optician necessarily has to position the adhesive pad 5 correctly, in a predetermined position, on the lower face 28 of the annular wall 22 of the positioning and centering pin 4 so as to subsequently allow the unit formed by the positioning and centering pin 4 and the adhesive pad 5 to be correctly positioned on the lens 2.

To this end, the optician takes the positioning and centering pin 4 and the adhesive pad 5 and goes to the machine 1 which comprises two tools 20.

The optician mounts the adhesive pad 5 on the body 42 of the tool 20, and in particular the optician introduces this adhesive pad 5 into the main cavity 46 in the body 42, with the protrusion 56 of the tool 20 passing through the orifice 35 in the adhesive pad 5 until the lower face 37 of the adhesive pad 5 is in contact with the bottom 47 of this main cavity 46 and in at least partial contact with regions of the peripheral contour 51 of the block 42.

The adhesive pad 5 is thus positioned and centered with respect to the body 42 of the tool 20 in a predetermined position, with the gripping tongue 39 of the adhesive pad 5 being received in the indentation 53 provided in the peripheral rim 48 of the block 42.

The adhesive pad 5 is then positioned correctly and centered with respect to the body 42 of the tool 20.

The optician can then remove the protective film (not shown) which covers the upper face 36 of the adhesive pad 5.

Once the protective film (not shown) has been removed, the optician moves the positioning and centering pin 4 up, with the lower face 28 of the annular wall 22 and the lower face 24 of the base 21 turned toward the upper face 36 of the adhesive pad 5.

Of course, it will be noted that the adhesive pad 5 could be turned over, since the upper and lower faces 36, 37 are identical, i.e. they are both adhesive.

The positioning and centering pin 4 is then mounted on the body 42 of the tool 20, and in particular it is partially inserted into the main cavity 46 in the body 42 until the lower face 28 of the annular wall 22 comes into contact with the upper face 36 of the adhesive pad 5.

The positioning and centering pin 4 is guided both by the stem 57, the two regions of which are received respectively in the hole 26 and the cutout 58 in the positioning and centering pin 4, and by the peripheral rim 48 of the body 42.

The positioning tabs 31 of the annular wall 22 are received in the notches 52 provided in the peripheral rim 48 of the block 42 and the protuberance 33 of this annular wall 22 is for its part received in the indentation 53 provided in this peripheral rim 48.

The positioning and centering pin 4 is thus both guided and centered by virtue of this stem 57 and of this peripheral rim 48, on account of the notches 52 and the indentation 53 which engage with the positioning tabs 31 and the protuberance 33, respectively.

The optician, who has correctly positioned and centered, in a predetermined position and with predetermined centering, both the adhesive pad 5 with respect to the body 42 of the tool 20 and the positioning and centering pin 4 with respect to the body 42 of the tool 20, can apply a sufficient force to the base 21 of the positioning and centering pin 4 to ensure that the latter is attached by way of the adhesive pad 5.

By virtue of the tool 20, the optician can very easily and very rapidly attach the elastic pad 5 to the positioning and centering pin 4 in a predetermined correct position, subsequently ensuring the proper progress of the steps for manufacturing the ophthalmic lens 2 which will be attached by way of its front face 6 to the lower face 37 of the adhesive pad 5, once the optician has removed the protective film (not shown) that covers this lower face 37, has arranged the base 21 of the positioning and centering pin 4 together with the adhesive pad 5, has attached the latter in the cavity 17 in the holding protrusion 16 of the robot arm 9 and once the optician has furthermore activated the machine 1.

Of course, the unit formed by the positioning and centering pin 4 and the adhesive pad 5 is positioned on the robot arm without the tool 20.

Beforehand, the optician thus has to remove the unit formed by the positioning and centering pin 4 and the adhesive pad 5 from this tool 20, by acting on a void 54 next to the gripping tongue 39 and the protuberance 33 and also on this gripping tongue 39 and on this protuberance 33 in order to extract this unit from the main cavity 46 in the body 42 of the tool 20.

Figure 4:
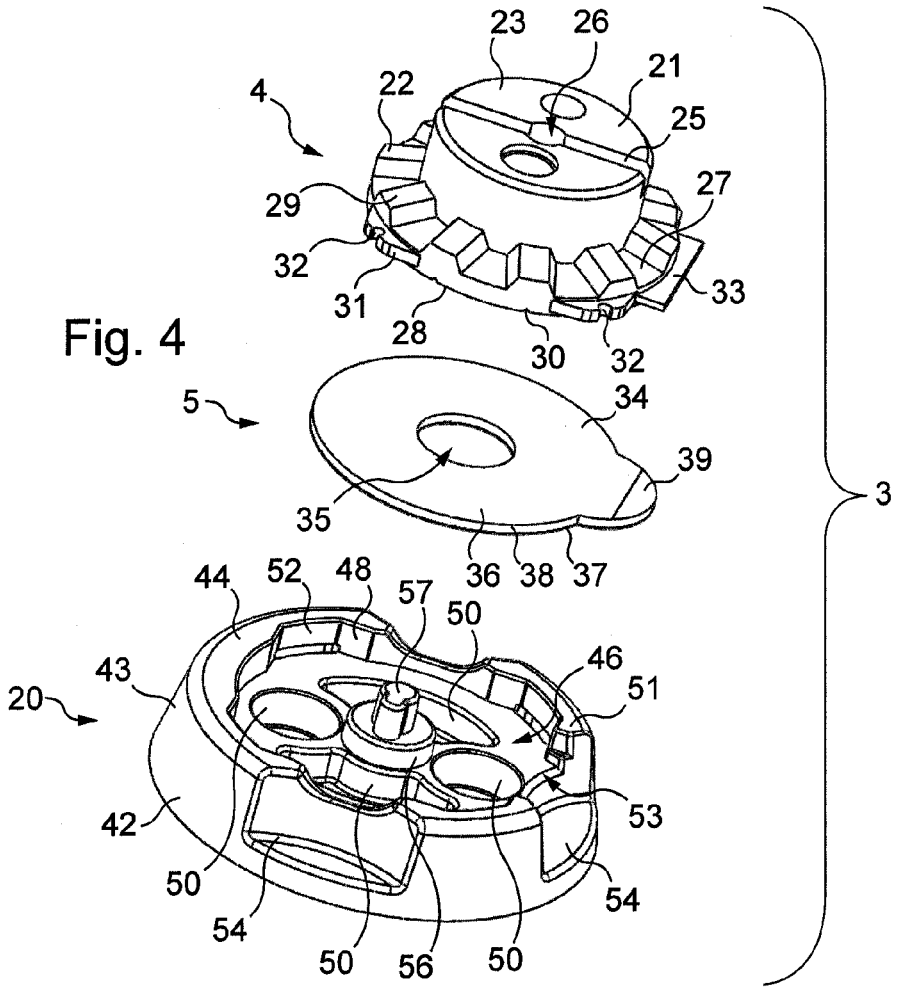
FIGS. 4 and 5 schematically and partially show perspective views of the system illustrated in FIG. 3 from two different viewing angles in an exploded state.
Figure 5:
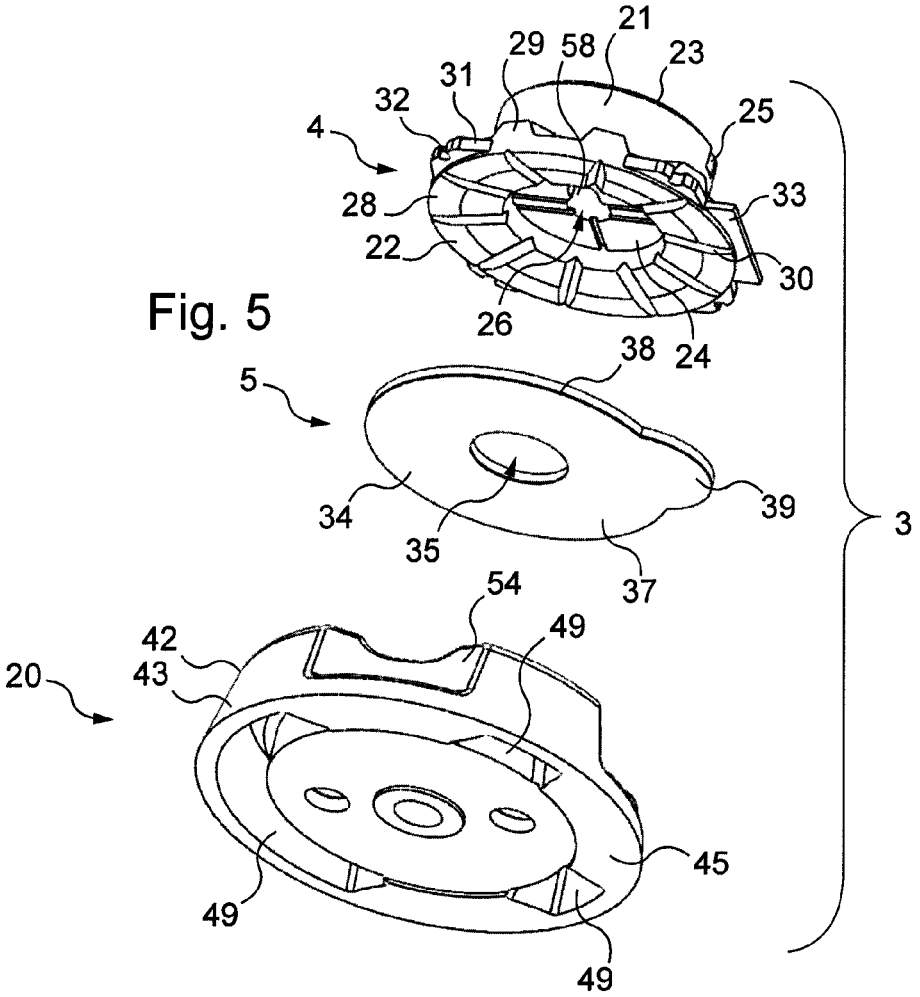
Figure 6:
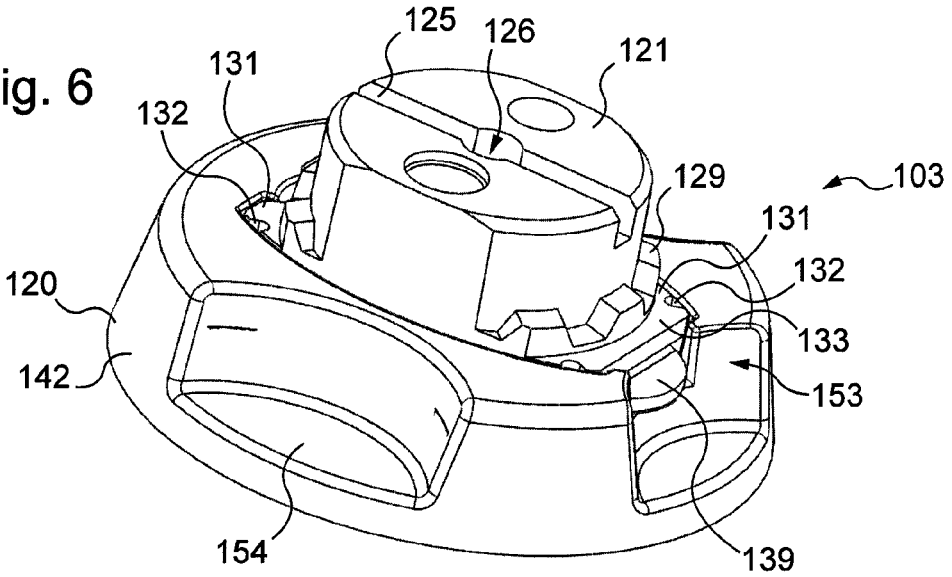
FIGS. 6 to 8 are views similar to FIGS. 3 to 5, respectively, of a system provided with a tool, a positioning and centering pin and an attachment member, in a variant of the system from FIGS. 3 to 5.
Figures 7, 8:
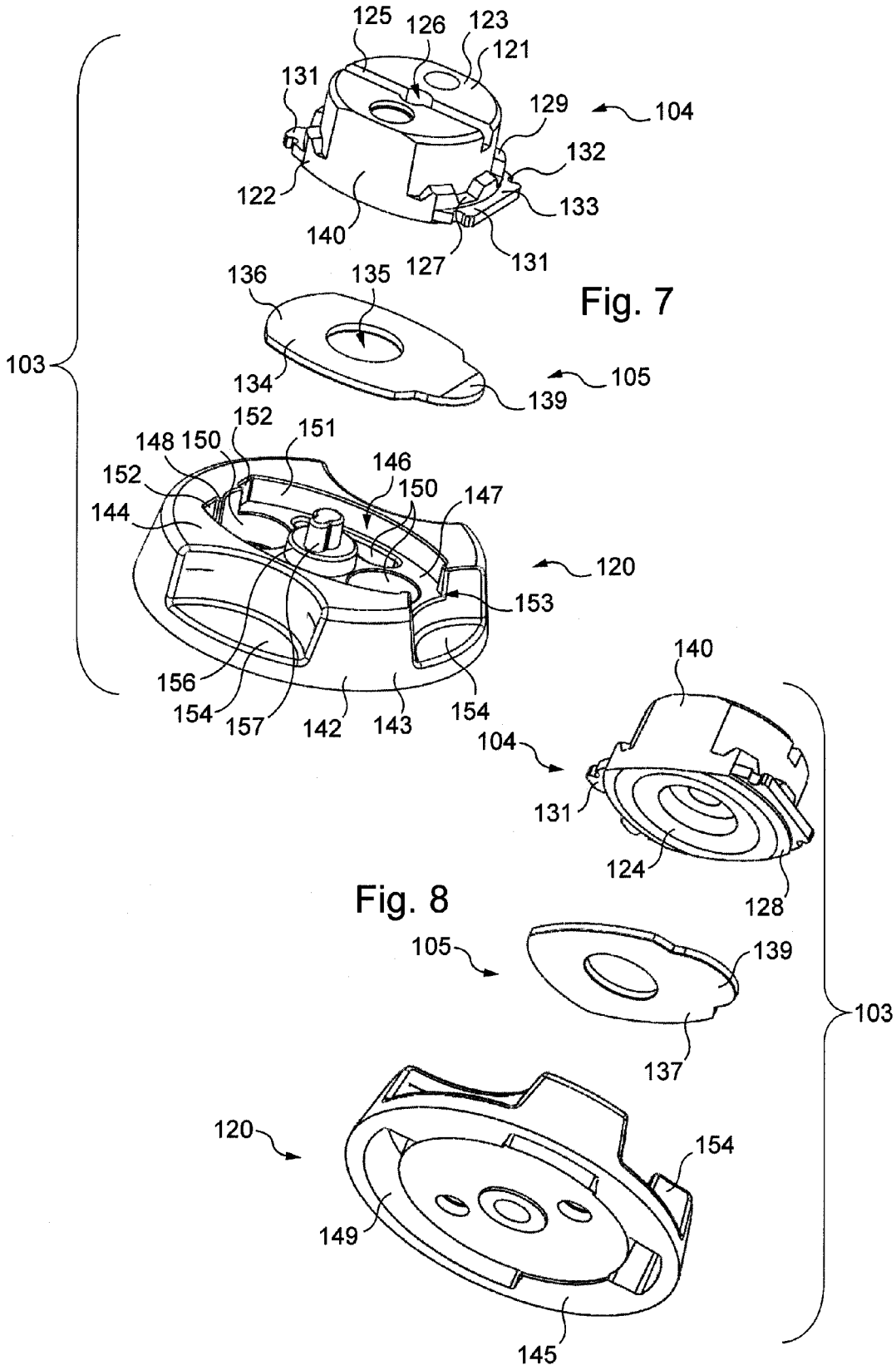
Figure 9:
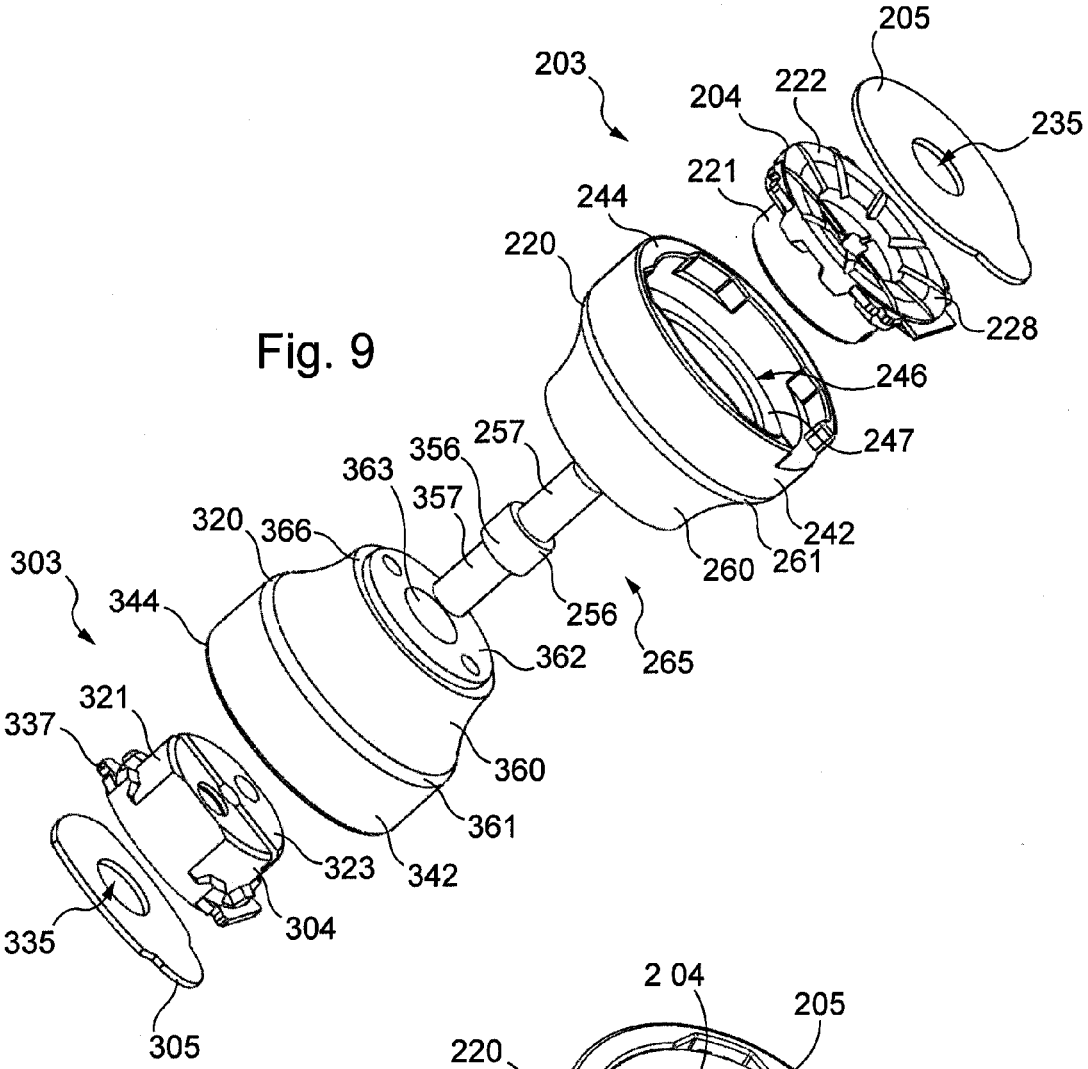
FIGS. 9 to 12 schematically and partially show perspective views of a group of systems, each in accordance with a second embodiment and each provided with a tool, a positioning and centering pin and an attachment member, from different viewing angles and in an assembled state and an exploded state, respectively.
Figure 10:
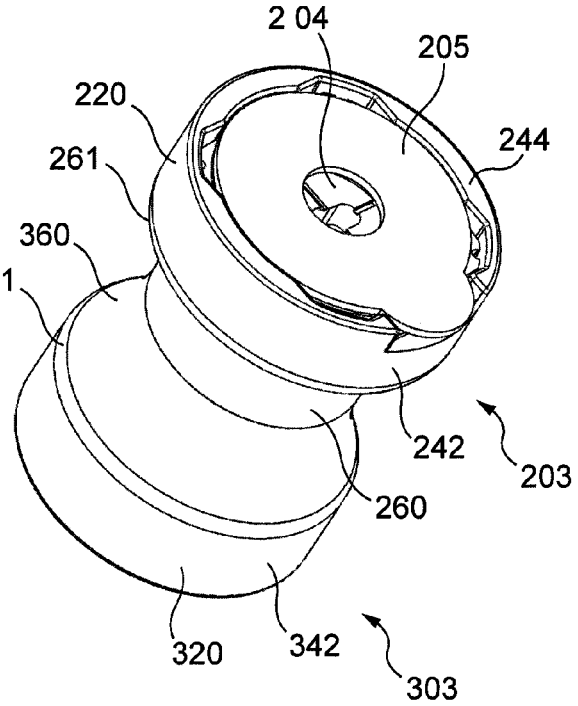
Figure 11:
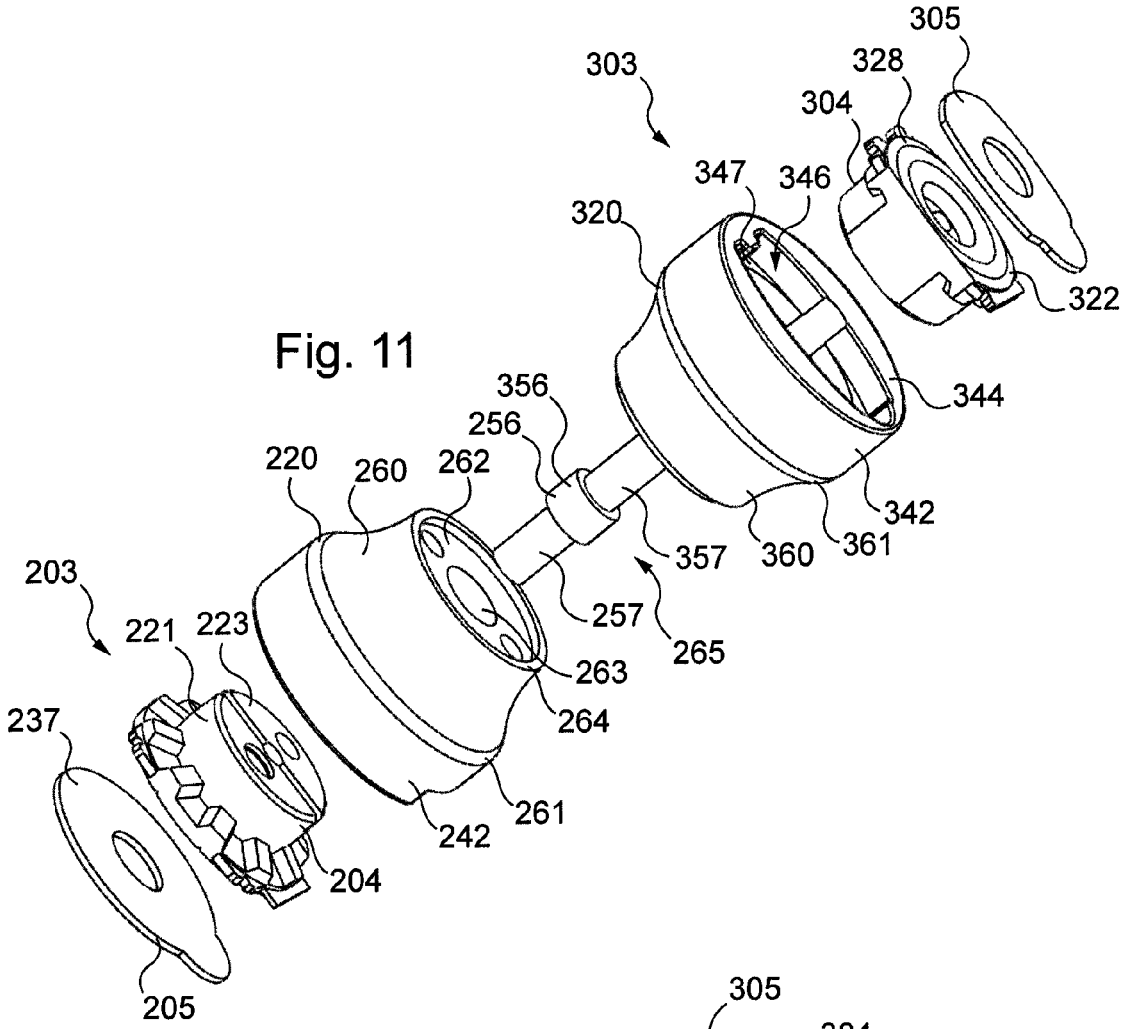
Figure 12:
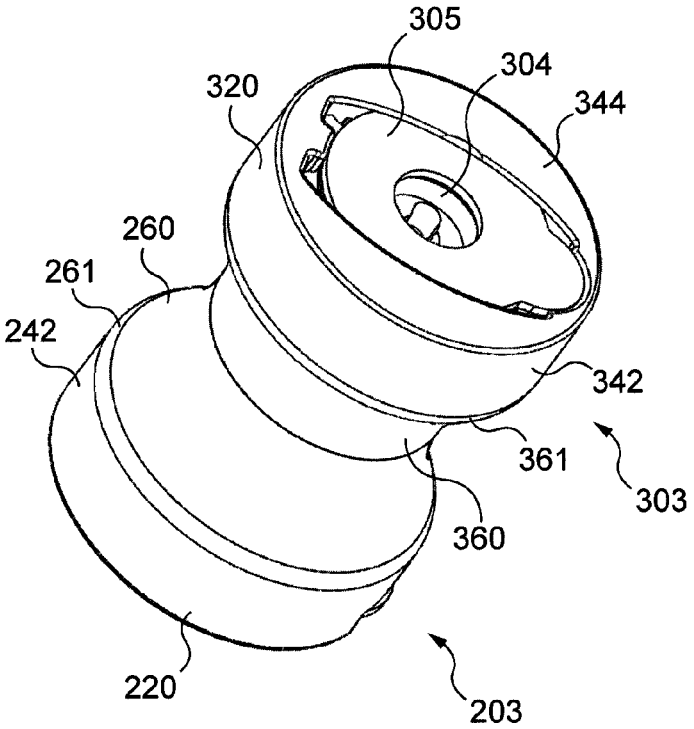

FIGS. 6 to 8 illustrate a variant embodiment of the system, showing a smaller version of the system, compared with the larger version of the system illustrated in FIGS. 3 to 5.

Generally, the same references have been used for similar elements, but with the addition of 100.

The system 103 comprises a positioning and centering pin 104, an adhesive pad 105, also referred to as the attachment member, and a tool 120 having the same function as the tool 20 shown in FIGS. 3 to 5.

The positioning and centering pin 104 is identical in all respects to the positioning and centering pin 4 shown in FIGS. 3 to 5, except that it does not have a circular overall shape, but rather an elongate overall shape.

Specifically, this positioning and centering pin 104 has a base 121 having an upper face 123, a lower face 124 opposite the upper face 123, a slot 125 that passes radially through it and a hole 126 that opens onto the upper and lower faces 123 and 124.

This positioning and centering pin 104 also has a wall 122 which in this case is semi-annular and is provided with an upper face 127, a lower face 128 opposite the upper face 127, a plurality of teeth 129, positioning tabs 131 that each have a slight depression 132, and a protuberance 133.

In this case, the base 121 and the semi-annular wall 122 are provided with diagonally opposite flattened regions 140 so as to have more of an elongate shape.

In these flattened regions 140, there are of course no teeth 129 and no positioning tabs 131.

Moreover, two of the positioning tabs 131 of the semi-annular wall 122 are formed together with the protuberance 133, and the two other positioning tabs 131 are slightly trimmed such that they have more of a triangular overall shape than the overall shape of a rectangular trapezoid.

The adhesive pad 105 is identical in all respects to the adhesive pad 5 shown in FIGS. 3 to 5, except that it has an elongate overall shape rather than a circular overall shape.

This adhesive pad 105 is thus provided with a body 134 with an elongate shape in which an orifice 135 is provided.

This adhesive pad 105 also has an upper face 136, a lower face 137 opposite the upper face 136, and an external peripheral rim 138 from which a gripping tongue 139 protrudes.

This adhesive pad 105 is also covered, in the initial state, with protective films (not shown).

The tool 120 is identical in all respects to the tool 20 shown in FIGS. 3 to 5, except that it has a smaller size, corresponding to the size of the positioning and centering pin 104 and the size of the adhesive pad 105.

The tool 120 thus has in particular a body 142 having an external side wall 143 in which voids 154 are provided and having a main cavity 146 delimited by a bottom 147 and a peripheral rim 148.

Voids 150 with different shapes are provided in the bottom 147 and an indentation 143 is furthermore provided in the peripheral rim 148.

The body 142 of the tool 120 also has an upper face 144, a lower face 145 opposite this upper face 144, and also voids 149 provided in this lower face 145.

The body 142 of the tool 120 also has two notches 152 provided in the peripheral rim 148.

The main cavity 146 has a peripheral contour 151, in this case with an elongate shape relative to the shape of the adhesive pad 105 and of the positioning and centering pin 104.

The unit formed by the main cavity 146, in particular its peripheral contour 151 and its bottom 147, and by the peripheral rim 148 defines a receiving recess for the adhesive pad 105 which is received, by way of its lower face 137, on the bottom 147 and on a first part of the peripheral rim 148, said first part being located at the junction between this peripheral rim 148 and the bottom 147, and wherein the positioning and centering pin 104 is received, in particular on a second part of this peripheral rim 148, said second part being located away from the first part of this peripheral rim 148.

The tool 120 also has a protrusion 156 protruding from the bottom 147 of the main cavity 146, and also a stem 157 protruding from this protrusion 156.

This protrusion 156 and this stem 157 are identical to the protrusion 56 and the stem 57 that are shown in FIG. 4.

The method for positioning the adhesive pad 105 on the lower face 128 of the semi-annular wall 122 of the positioning and centering pin 104 via the tool 120 on which this adhesive pad 105 and this positioning and centering pin 104 are mounted in a guided and centered manner is identical to the method for positioning the adhesive pad 5 on the positioning and centering pin 4 by virtue of the tool 20, these being illustrated in FIGS. 3 to 5.

The optician takes the adhesive pad 105 and introduces it into the main cavity 146 in the tool 120 until the lower face 137 of the pad 105 comes into contact with the bottom 147 of the main cavity 146, with the external peripheral rim 138 of this adhesive pad 105 being next to the peripheral contour 151 of this main cavity 146, and with the gripping tongue 139 being received in the indentation 153 provided in the peripheral rim 148 of the tool 120.

The adhesive pad 105 is thus guided and centered with respect to the body 142 of the tool 120, in particular by virtue of the protrusion 156 which passes through the orifice 135 in the adhesive pad 105.

The optician then removes the protective film (not shown) covering the upper face 136 of the adhesive pad 105 and mounts the positioning and centering pin 104 on the body 142 of the tool 120, with the lower face 128 of the semi-annular wall 122 and the lower face 124 of the base 121 turned toward the upper face 136 of the adhesive pad 105.

The positioning and centering pin 104 is partially introduced into the main cavity 146 in the body 142, with the stem 157 being introduced both into the hole 126 and into a cutout (not shown) provided in the lower face 124 of the base 121, with two positioning tabs 131 being received in the notches 152 provided in the peripheral rim 148 of the body 142, with the flattened regions 140 being located at least partially next to the peripheral contour 151 of the main cavity 146, and with the protuberance 133 and the two positioning tabs 131 that are formed together with this protuberance 133 being received in the indentation 153 provided in this peripheral rim 148.

This positioning and centering pin 104 is thus both centered and guided with respect to the body 142 of the tool 120.

The optician can then act on the positioning and centering pin in order to attach the adhesive pad 105 to the latter.

The unit formed by the positioning and centering pin 104 and the adhesive tab 105 is removed from the tool 120 by acting on the gripping tongue 139 of the adhesive pad 105 and on the protuberance 133 of the positioning and centering pin 104.

The systems 3 and 103 illustrated in FIGS. 3 to 8 form a group of systems.

This group is thus formed by a first system 3 having a first adhesive pad 5, a first positioning and centering pin 4 and a first tool 20, each having a respective first predetermined size. Here, this first size is defined by the outside diameter of the annular wall 22 of the positioning and centering pin 4 and by the outside diameter of the adhesive pad 5, each being equal to around 20 mm.

This group thus also comprises a second system 103 having a second adhesive pad 105, a second positioning and centering pin 104 and a second tool 120, each having a respective second predetermined size. Here, this second predetermined size is defined by the largest outside diameter of the semi-annular wall 122 of the positioning and centering pin 104 and by the outside diameter of the adhesive pad 105, each being equal to around 16 mm.

The first system 3 thus has a first predetermined size greater than the second predetermined size that the second system 103 has.

FIGS. 9 to 12 illustrate a variant embodiment of the group of systems, showing what is referred to as an assembled version of the group, compared with what is referred to as the disassembled version of the group illustrated in FIGS. 3 to 8.

Furthermore, the group illustrated in FIGS. 9 to 12 is formed by systems in accordance with an embodiment that is different than the systems illustrated in FIGS. 3 to 8.

Generally, the same references have been used for elements similar to the elements of the system 3 illustrated in FIGS. 3 to 5 and of the system 103 illustrated in FIGS. 6 to 8, but with the addition of 200.

The positioning and centering pin 204 and the adhesive pad 205 of the system 203 illustrated in FIGS. 9 to 12 are identical in all respects to the positioning and centering pin 4 and the adhesive pad 5 of the system 3 illustrated in FIGS. 3 to 5.

Furthermore, the positioning and centering pin 304 and the adhesive pad 305 of the system 303 illustrated in FIGS. 9 to 12 are identical in all respects to the positioning and centering pin 104 and the adhesive pad 105 of the system 103 illustrated in FIGS. 6 to 8.

The tool 220 illustrated in FIGS. 9 to 12 is very similar to the tool 20 illustrated in FIGS. 3 to 5, except that this tool 220 has a body 242 which is extended by a frustoconical portion 260 fastened to the body 242 at its lower face (not shown) via a shoulder 261.

Furthermore, the body 242 has a main cavity 246 with multiple levels, i.e. it has a first end wall 247 and also a second end wall 262 (FIG. 11) that are located more deeply in the main cavity 246, i.e. at that end of the frustoconical portion 260 that is opposite the main opening in the main cavity 246, at the upper face 244 of the body 242.

This second end wall 262 has a central circular opening 263.

The frustoconical portion 260 is furthermore provided at its end opposite the upper face 244 of the body 242 with a peripheral rim 264 that protrudes from the second end wall 262 and forms what is referred to as an interlocking rim.

The second end wall 262 and the rim 264 form an interlocking face.

The tool 220 also has a protrusion 256 and also a stem 257, which are formed here in one piece with a protrusion 356 and a stem 357 that are provided for the tool 320.

These protrusions 256, 356 and stems 257, 357 are formed on a shared bar 265 that is configured to connect the tool 220 to the tool 320, and is more generally configured to connect the system 203 to the system 303 in order to form the group of systems.

The tool 320 is for its part very similar to the tool 120 shown in FIGS. 6 to 8, except that this tool 320 has a body 342 which is extended by a frustoconical portion 360 fastened to this body 342 via a shoulder 361.

This frustoconical portion 360 is located at the lower face (not shown) of the body 342.

This body 342 also has a main cavity 346 that is much deeper than the main cavity 146 of the tool 120 shown in FIGS. 6 to 8.

This main cavity 346 has a first end wall 347 and a second end wall 362 opposite the upper wall 344 of the body 342.

The second end wall 362 has a circular opening 363 provided in its center.

The frustoconical portion 360 also has, at its end opposite the upper wall 344 of the body 342, a shoulder 366 referred to as the interlocking shoulder.

The second end wall 362 and the rim 366 form a complementary interlocking face.

This interlocking shoulder 366 is configured to come into contact with the peripheral rim 264 of the frustoconical portion 260 of the tool 220, with the second end wall 362 thus being configured to come into bearing contact with the second end wall 262 so as to interlock the tool 220 with the tool 320.

Furthermore, the shared bar 265 is for its part configured such that the protrusion 256 and the stem 257 pass at least partially through the opening 263 provided in the second end wall 262 and such that the protrusion 356 and the stem 357 pass at least partially through the opening 363 provided in the second end wall 362.

The method for positioning the adhesive pad 205 on and attaching it to the positioning and centering pin 204 by virtue of the tool 220, and the method for positioning the adhesive pad 305 on and attaching it to the positioning and centering pin 304 by virtue of the tool 320 will now be described.

The methods are identical in all respects and so only one method is described below.

Here, the optician first of all takes the positioning and centering pin 204 or 304, respectively, and introduces it into the main cavity 246 or 346, respectively, with the upper face 223 or 323, respectively, of the base 221 or 321, respectively, turned toward the bottoms 247 and 262 or 347 and 362, respectively, of the main cavity 246 or 346, respectively.

The positioning and centering pin 204 or 304, respectively, is guided and centered with respect to the body 242 or 342, respectively, by virtue of its being fitted around the protrusion 256 or 356, respectively, and the stem 257 or 357, respectively.

Furthermore, it will be noted that the same error-proofing elements and removal elements as those in the systems 3 and 103 illustrated in FIGS. 3 to 8 are found in the systems 203 and 303.

The only difference is that the body 242 or 342, respectively, does not have voids such as the voids 49, 50 and 54 in the body 42 of the tool 20 shown in FIGS. 3 to 5 and the voids 149, 150 and 154 in the body 142 of the tool 120 shown in FIGS. 6 to 8.

Once the positioning and centering pin 204 and 304, respectively, has been positioned, guided and centered with respect to the body 242 or 342, respectively, the optician takes the adhesive pad 205 or 305, respectively, and likewise introduces it into the main cavity 246 or 346, respectively, with its lower face 237 or 337, respectively, turned toward the lower face 228 or 328, respectively, of the annular wall 222 or of the semi-annular wall 322, respectively.

The adhesive pad 205 or 305, respectively, is positioned, guided and centered with respect to the body 242 or 342, respectively, on the positioning and centering pin 204 or 304, respectively, by virtue in particular of the stem 257 or 357, respectively, which passes through the orifice 235 or 335, respectively, of the adhesive pad 205 or 305, respectively.

The optician then presses on the adhesive pad 205 or 305, respectively, in order to attach the latter sufficiently to the positioning and centering pin 204 or 304, respectively.

Of course, the optician will previously have taken the precaution of removing the protective film (not shown) covering the lower face 237 or 337, respectively, of the adhesive pad 205 or 305, respectively.

The unit formed by the positioning and centering pin 204 or 304, respectively, and by the adhesive pad 205 or 305, respectively, is removed in the same way as for the systems 3 and 103 illustrated in FIGS. 3 to 8 by acting on the same removal elements which the positioning and centering pin 204 or 304, respectively, and the adhesive pad 205 or 305, respectively, have.

Furthermore, the group formed by the systems 203 and 303 is a group having systems with different predetermined sizes, since the system 203 has the same predetermined size as the system 3 illustrated in FIGS. 3 to 5 and the system 303 has the same predetermined size as the system 103 illustrated in FIGS. 6 to 8.

In variants that are not illustrated:

- the attachment member does not have a cylindrical overall shape or an elongate overall shape, but rather a rectangular, or even parallelepipedal, overall shape, and if need be, the body of the tool also has a rectangular, or even parallelepipedal, overall shape;
- the attachment member does not have a contact surface similar to that of the positioning and centering pin but rather a smaller or larger contact surface than that of this pin;
- the attachment member and/or the positioning and centering pin do not have a central orifice and/or central hole, respectively, but rather the attachment member and/or the positioning pin are solid;
- the attachment member does not have a gripping tongue for removing the unit formed by this member and by the positioning and centering pin, and thus the body of the tool does not have an indentation provided in its peripheral rim in order to receive such a tongue;
- the positioning and centering pin does not have a protuberance for removing the unit formed by this member and by the positioning and centering pin, and thus the body of the tool does not have an indentation provided in its peripheral rim in order to receive such a protuberance;
- the positioning and centering pin does not have a positioning tab protruding from the base of the pin but rather depressions provided in this base, and if need be, the body of the tool does not have notches configured to receive such tabs but rather protuberances configured to be inserted into the depressions in the pin;
- the positioning and centering pin and the attachment member that are shown in FIGS. 3 to 5 do not have a major diameter of around 20 mm, but more generally a major diameter of between around 18 mm and 22 mm;
- the positioning and centering pin and the attachment member that are shown in FIGS. 6 to 9 do not have a mean diameter of around 16 mm, but rather generally a mean diameter of between around 14 mm and 18 mm;
- the shared bar is not a bar for connecting the two tools but serves to eject the "pin/attachment member" unit;
- the tool is not integrated directly into the casing of a machine such as the one illustrated in FIG. 1, but rather this tool is separate and is thus referred to as individual;
- the system is wrapped in a pack, also referred to as a blister pack, with the positioning and centering pin and the attachment member being mounted on the tool, and if need be, the unit formed by the system and the pack is easy to transport and store;
- the system is wrapped in a pack, also referred to as a blister pack, with the positioning and centering pin and the attachment member each being in different separate spaces in the blister pack, and if need be, the unit formed by the system and the pack is easy to transport and store;
- the group illustrated in FIGS. 9 to 12 does not have two separate tool bodies that are interlockable and have a shared bar, but rather the group has two tool bodies that are molded in one piece from plastics material, each of the bodies having its own protrusion and its own stem; and/or
- the group illustrated in FIGS. 9 to 12 does not have just two tools but rather 3, or even 4 tools that are separate from one another.

It will be recalled more generally that the invention is not limited to the examples described and shown.

The invention claimed is:

1. A system comprising a positioning and centering pin (4; 104; 204; 304) for an ophthalmic lens (2), said positioning and centering pin (4; 104; 204; 304) being configured to be attached to said ophthalmic lens (2), and an attachment member (5; 105; 205; 305) configured to be positioned on said positioning and centering pin (4; 104; 204; 304) and to be attached to the latter and also to be attached to said ophthalmic lens (2), characterized in that said system also has a tool (20; 120; 220; 320) for positioning said attachment member (5; 105; 205; 305) on said positioning and centering pin (4; 104; 204; 304), said tool (20; 120; 220; 320) having a body (42; 142; 242; 342) provided with at least one receiving recess configured to at least partially receive at least one of said attachment member (5; 105; 205; 305) and said positioning and centering pin (4; 104; 204; 304), at least one centering member (48, 56; 148, 156; 257) for centering said attachment member (5; 105; 205; 305), and at least one guiding member (48, 57; 148, 157; 256) for guiding said positioning and centering pin (4; 104; 204; 304); said recess, said at least one centering member (48, 56; 148, 156; 257) and said at least one guiding member (48, 57; 148, 157; 256) being configured such that, when said attachment member (5; 105; 205; 305) and said positioning and centering pin (4; 104; 204; 304) are mounted on said tool (20; 120; 220; 320), said attachment member (5; 105; 205; 305) is centered with respect to said body (42; 142; 242; 342) and said positioning and centering pin (4; 104; 204; 304) is guided with respect to said body (42; 142; 242; 342); by virtue of which said attachment member (5; 105; 205; 305) is positioned in a predetermined position on said positioning and centering pin (4; 104; 204; 304).

2. The system as claimed in claim 1, characterized in that at least one of said positioning and centering pin (4; 104; 204; 304) and said attachment member (5; 105; 205; 305) has a cylindrical overall shape having a peripheral contour, and said body (42; 142; 242; 342) has a cavity (46; 146; 246; 346) having a cylindrical overall shape delimited by a bottom (47; 147; 247; 347) and a peripheral rim (48; 148), said cavity (46; 146; 246; 346) having a peripheral contour (51; 151) at least partially similar to and at least as large as said peripheral contour of at least one of said positioning and centering pin (4; 104; 204; 304) and said attachment member (5; 105; 205; 305), and said guiding member for guiding said positioning and centering pin (4; 104; 204; 304) is at least partially formed by said peripheral rim (48; 148).

3. The system as claimed in claim 2, characterized in that said at least one receiving recess is provided in at least one part of said bottom (47; 147; 247; 347) of said cavity (46; 146; 246; 346) in said body (42; 142; 242; 342) and in at least one first part of said peripheral rim (48; 148) of said body (42; 142; 242; 342), said first part of said peripheral rim (48; 148) being located at the junction with said bottom (47; 147; 247; 347).

4. The system as claimed in claim 3, characterized in that said at least one centering member for centering said attachment member (5; 105) is formed by a protrusion (56; 156) protruding from a bottom (47; 147) of a cavity (46; 146) in said body (42; 142), and said attachment member (5; 105) has an orifice (35; 135) configured for said protrusion (56; 156) to pass through.

5. The system as claimed in claim 2, characterized in that said at least one receiving recess is provided in at least one second part of said peripheral rim (48; 148) of said body (42; 142; 242; 342), said second part of said peripheral rim (48; 148) being located away from said bottom (47; 147; 247; 347) of said cavity (46; 146; 246; 346) in said body (42; 142; 242; 342).

6. The system as claimed in claim 2, characterized in that said at least one centering member for centering said attachment member (5; 105) is formed by a protrusion (56; 156) protruding from a bottom (47; 147) of a cavity (46; 146) in said body (42; 142), and said attachment member (5; 105) has an orifice (35; 135) configured for said protrusion (56; 156) to pass through.

7. The system as claimed in claim 1, characterized in that said at least one centering member for centering said attachment member (5; 105) is formed by a protrusion (56; 156) protruding from a bottom (47; 147) of a cavity (46; 146) in said body (42; 142), and said attachment member (5; 105) has an orifice (35; 135) configured for said protrusion (56; 156) to pass through.

8. The system as claimed in claim 7, characterized in that said at least one guiding member for guiding said positioning and centering pin (4; 104) is formed by a stem (57; 157) protruding from said protrusion (56; 156), and said positioning and centering pin (4; 104) has a hole (26; 126) configured to receive said stem (57; 157).

9. The system as claimed in claim 1, characterized in that said positioning and centering pin (4; 104) has at least one error-proofing element (31; 131) and said body (42; 142) of said tool (20; 120) has at least one complementary error-proofing element (52; 152) configured to engage with said at least one error-proofing element (31; 131) of said positioning and centering pin (4; 104).

10. The system as claimed in claim 9, characterized in that said at least one error-proofing element of said positioning and centering pin (4; 104) is formed by a positioning tab (31; 131) and said at least one complementary error-proofing element of said body (42; 142) of said tool (20; 120) is formed by a notch (52; 152) provided in a peripheral rim (48; 148) of said body (20; 120) and configured to receive said positioning tab (31; 131).

11. The system as claimed in claim 1, characterized in that said attachment member (5; 105) has at least one first removal element (39; 139), said positioning and centering pin (4; 104) has at least one second removal element (3; 133) and said body (42; 142) of said tool (20; 120) has at least one complementary removal element (53; 153) configured to engage with said at least one first removal element (39; 139) and with said at least one second removal element (53; 153).

12. The system as claimed in claim 11, characterized in that said at least one first removal element of said attachment member (5; 105) is formed by a gripping tongue (39; 139), said at least one second removal element of said positioning and centering pin (4; 104) is formed by a protuberance (33; 133) and said at least one complementary removal element of said body (42; 142) of said tool (20; 120) is formed by an indentation (53; 153) provided in a peripheral rim (48; 148) of said body (42; 142) and configured to receive said tongue (39; 139) and said protuberance (33; 133).

13. A group of systems, characterized in that it has a first system (3; 203) as claimed in claim 1 and a second system; said first system (3; 203) having a first attachment member (5; 205), a first positioning and centering pin (4; 204) and a first tool (20; 220), each having a respective first predetermined size, and said second system (103; 303) having a second attachment member (105; 305), a second positioning and centering pin (104; 304) and a second tool (120; 320), each having a respective second predetermined size that is less than said first predetermined size.

14. The group as claimed in claim 13, characterized in that said first tool (203) has a first body (242, 260) provided with a first interlocking face (262, 266) and said second tool (303) has a second body (342, 360) provided with a complementary second interlocking face (362, 366) configured to be received in said first interlocking face (262, 266).

15. The group as claimed in claim 14, characterized in that it also has a bar (265) that is shared by the first and second systems (203, 303) and is configured to pass through said first and second bodies (242, 342), said bar (265) having a central portion that forms a protrusion for centering said first and second attachment members (205, 305) and two end portions (257, 357) that are disposed on either side of said central portion (256, 356), said end portions (257, 357) forming guiding stems for guiding the first and second positioning and centering pins (204, 304), respectively.

16. A machine for positioning an ophthalmic lens (2) on and attaching it to a positioning and centering pin (4; 104; 204; 304) by way of an attachment member (5; 105; 205; 305) previously positioned on and attached to said positioning and centering pin (4; 104; 204; 304), having at least one system (3; 103; 203; 303) as claimed in claim 1.

17. The system as claimed in claim 3, characterized in that said at least one receiving recess is provided in at least one second part of said peripheral rim (48; 148) of said body (42; 142; 242; 342), said second part of said peripheral rim (48; 148) being located away from said bottom (47; 147; 247; 347) of said cavity (46; 146; 246; 346) in said body (42; 142; 242; 342).

18. A method for positioning an attachment member (5; 105; 205; 305) on a positioning and centering pin (4; 104; 204; 304) for an ophthalmic lens (2) with the aid of a system (3; 103; 203; 303) having the following steps of:

providing a positioning and centering pin (4; 104; 204; 304) for an ophthalmic lens (2), said positioning and centering pin (4; 104; 204; 304) being configured to be attached to said ophthalmic lens (2);

providing an attachment member (5; 105; 205; 305) configured to be positioned on said positioning and centering pin (4; 104; 204; 304) and to be attached to the latter and also to be attached to said ophthalmic lens (2);

the method being characterized in that it also comprises the following steps of:

providing a tool (20; 120; 220; 320) having a body (42; 142; 242; 342) provided with at least one receiving recess configured to at least partially receive at least one of said attachment member (5; 105; 205; 305) and said positioning and centering pin (4; 104; 204; 304), with at least one centering member (48, 56; 148, 156; 257) for centering said attachment member (5; 105; 205; 305), and with at least one guiding member (48, 57; 148, 157; 256) for guiding said positioning and centering pin (4; 104; 204; 304);

at least partially disposing at least one of said attachment member (5; 105; 205; 305) and said positioning and centering pin (4; 104; 204; 304) in said at least one receiving recess;

guiding said positioning and centering pin (4; 104; 204; 304) with respect to said body (42; 142; 242; 342) by way of said at least one guiding member (48, 57; 148, 157; 256) for guiding said tool (20; 120; 220; 320);

centering said attachment member (5; 105; 205; 305) with respect to said body (42; 142; 242; 342) by way of said at least one centering member (48, 56; 148, 156; 257) for centering said tool (20; 120; 220; 320); by virtue of which said attachment member (5; 105; 205; 305) is positioned in a predetermined position on said positioning and centering pin (4; 104; 204; 304).

* * * * *